US005123268A

United States Patent [19]

Eizen

[11] Patent Number: 5,123,268

[45] Date of Patent: Jun. 23, 1992

[54] CYLINDER LOCK

[75] Inventor: Noach Eizen, Rishon Lezion, Israel

[73] Assignee: Mul-T-Lock Ltd., Yavne, Israel

[21] Appl. No.: 488,586

[22] Filed: Mar. 5, 1990

[30] Foreign Application Priority Data

May 5, 1989 [IL] Israel ..... 90211

[51] Int. Cl.[5] ..... E05B 27/04

[52] U.S. Cl. ..... 70/359; 70/493

[58] Field of Search ..... 70/357-361, 70/490, 493, 376, 378

[56] References Cited

U.S. PATENT DOCUMENTS

| | | | |
|---|---|---|---|
| 3,125 | 6/1843 | Voorhies | 70/359 X |
| 593,436 | 9/1897 | Rydberg . | |
| 1,095,500 | 5/1914 | Hansen . | |
| 1,741,390 | 12/1929 | Wise | 70/359 |
| 2,043,872 | 6/1936 | Wise | 70/359 X |
| 2,194,469 | 3/1940 | Fremon | 70/493 |
| 2,565,531 | 8/1951 | Spiegler | 70/493 |
| 2,653,467 | 9/1953 | Segal | 70/493 X |
| 3,494,158 | 2/1970 | Bauer et al. | 70/364 |
| 3,818,732 | 6/1974 | Tria et al. . | |
| 4,142,389 | 3/1979 | Bahry et al. . | |
| 4,856,309 | 8/1989 | Eizen | 70/359 |

FOREIGN PATENT DOCUMENTS

| | | | |
|---|---|---|---|
| 0238442A1 | 9/1987 | European Pat. Off. . | |
| 0297929A2 | 1/1989 | European Pat. Off. . | |
| 1122866 | 1/1962 | Fed. Rep. of Germany . | |
| 2752550 | 6/1978 | Fed. Rep. of Germany | 70/359 |
| 104176 | 10/1988 | Taiwan . | |

*Primary Examiner*—Gary L. Smith
*Assistant Examiner*—Suzanne L. Dino
*Attorney, Agent, or Firm*—Townsend and Townsend

[57] ABSTRACT

A cylinder lock including a housing and a plug disposed in the housing and arranged for rotation relative thereto, a first plurality of chambers formed in the housing and a second plurality of chambers formed in the plug and arranged such that each one of the first plurality of chambers extends coaxially with a corresponding one of the second plurality of chambers, when the plug is in a first rotational orientation relative to the housing, a first multi-element pin assembly being disposed in said first plurality of chambers and a second multi-element pin assembly being disposed in said second plurality of chambers, the first multi-element pin assembly including an outer pin element having an axial recess and an inner pin element disposed for selectable axial orientation relative to the outer pin element and apparatus for retaining the inner pin element against disengagement from and undesired misalignment with respect to the outer pin element.

8 Claims, 7 Drawing Sheets

CYLINDER LOCK

FIELD OF THE INVENTION

The present invention relates to cylinder locks generally and more particularly to cylinder locks of the pin tumbler type.

BACKGROUND OF THE INVENTION

A wide variety of cylinder locks of the pin tumbler type are known. In an effort to provide enhanced security, cylinder locks having a plurality of coaxial pins in each chamber have been developed. Locks of this description are disclosed in U.S. Pat. Nos. 593,436; 1,095,500; 3,818,732; and 4,142,389. Such locks, while providing a relatively high level of security, have a severe cost disadvantage in that they are extremely difficult and time consuming to assemble, master and service.

SUMMARY OF THE INVENTION

The present invention seeks to provide a high security cylinder lock having multiple pins in each chamber and which overcomes the disadvantages of prior art cylinder locks of this type.

There is thus provided in accordance with a preferred embodiment of the present invention a cylinder lock including a housing and a plug disposed in the housing and arranged for rotation relative thereto, a first plurality of chambers formed in the housing and a second plurality of chambers formed in the plug and arranged such that each one of the first plurality of chambers extends coaxially with a corresponding one of the second plurality of chambers, when the plug is in a first rotational orientation relative to the housing, a first multi-element pin assembly being disposed in said first plurality of chambers and a second multi-element pin assembly being disposed in said second plurality of chambers, the first multi-element pin assembly including an outer pin element having an axial recess and an inner pin element disposed for selectable axial orientation relative to the outer pin element and apparatus for retaining the inner pin element against disengagement from and undesired misalignment with respect to the outer pin element.

In accordance with a preferred embodiment of the present invention, the inner and outer pin elements are spring loaded with respect to each other.

Further in accordance with a preferred embodiment of the invention the apparatus for retaining the inner pin element comprises an axial extension of the inner pin element which slidably extends through a portion of the outer pin element and is configured so as not to be normally separable therefrom.

It is a particular feature of the present invention that the use of the multi-element pin assembly having retaining apparatus enables automated or semiautomated assembly of the lock to be practical and greatly simplifies mastering and servicing the lock.

Additionally in accordance with a preferred embodiment of the invention, the plug is formed with a plurality of circumferential grooves thereby defining a non-straight shear line between the housing and the plug.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
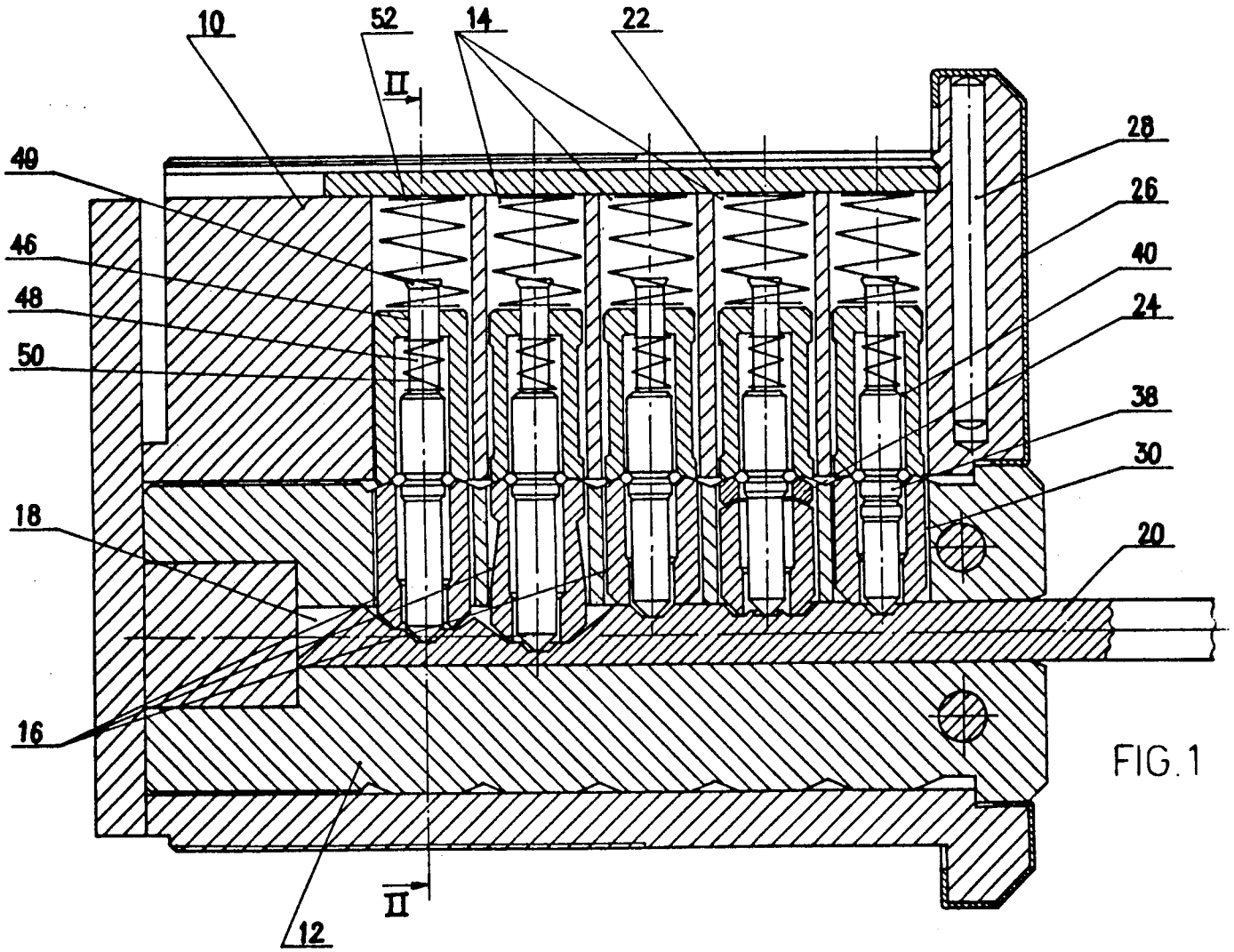
FIG. 1 is a side sectional illustration of a cylinder lock constructed and operative in accordance with a preferred embodiment of the present invention.
Figure 2:
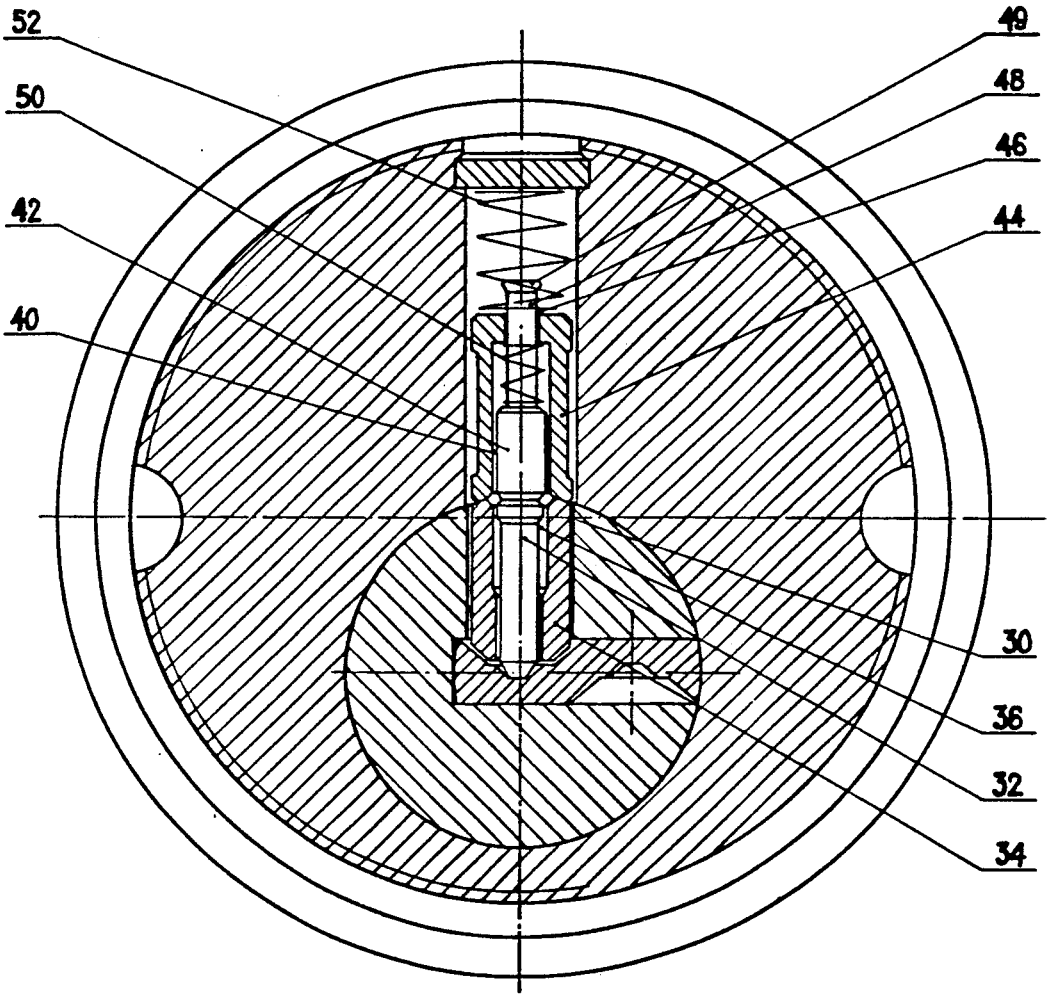
FIG. 2 is an enlarged sectional illustration of the lock of FIG. 1, taken along the lines II—II in FIG. 1.

Reference is now made to FIGS. 1 and 2, which illustrate a cylinder lock constructed and operative in accordance with a preferred embodiment of the present invention and comprising a housing 10 in which is defined a plug 12. As illustrated in FIG. 1, the plug 12 is formed with circumferential grooves to present a non-linear shear line therebetween.

The housing 10 and the plug 12 are formed with respective complementary housing chambers 14 and plug chambers 16, plug chambers 16 communicating with a keyway 18 in which is shown disposed a key 20. Housing chambers 14 communicate with the outer peripheral surface of housing 10 and are preferably closed by a removable sealing strip 22. The housing 10 preferably comprises an escutcheon 26 and a hardened pin 28. Pin 28 serves to prevent drilling damage to the cylinder.

Disposed in each of plug chambers 16 is a multi-element plug pin assembly 30 comprising a core pin element 32 and a peripheral pin element 34 having an aperture 36 through which slidably extends core pin element 32. Additionally, respective internal and external mastering disks 38 and 24 may be provided as appropriate.

Disposed in each of housing chambers 14 is a multi-element housing pin assembly 40 comprising a core pin element 42 and a peripheral pin element 44 having an aperture 46 through which slidably extends an extension 48 of core pin element 42. It is a particular feature of the present invention that disengagement of core pin element 42 from peripheral pin element 44 is prevented. In the illustrated embodiment, such disengagement is prevented by broadening the extreme end 49 of extension 48 so that it cannot pass through aperture 46. Alternatively, any other suitable means for preventing disengagement of the core pin element 42 from the peripheral pin element 44 and for maintaining them in generally coaxial alignment may be provided.

In accordance with the present invention, a compression spring 50 is disposed between core pin element 42 and peripheral pin element 44 such that the two elements are urged to a relative orientation whereby end 49 is drawn towards aperture 46. Another compression spring 52 is provided between the peripheral pin element 44 and the sealing strip 22 for urging the entire multi-element housing pin assembly towards the shearing line and towards chambers 16.

It is a particular feature of the present invention that, due to the fact that the housing pin assembly 40 is constructed so as to prevent undesired and inadvertent disengagement and misalignment thereof, assembly, mastering and servicing of the lock of FIG. 1 is greatly simplified and automated assembly of the lock and of the pin assembly may be realized, producing very significant cost savings.

Figure 3B:
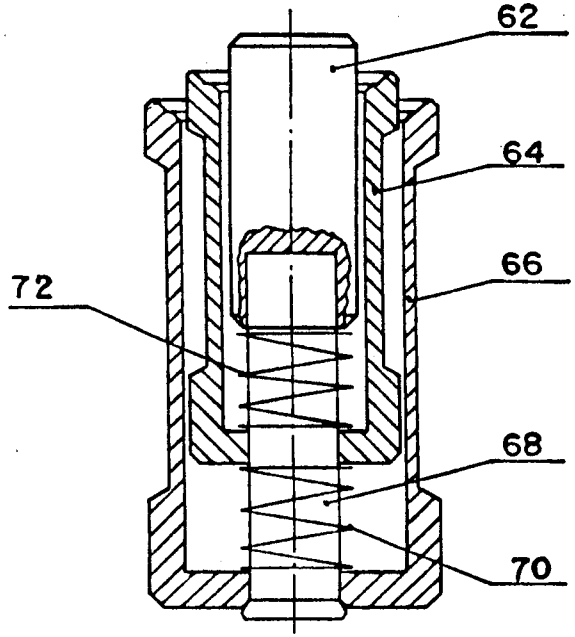
FIGS. 3A, 3B and 3C illustrate three alternative embodiments of multi-element pin assemblies constructed and operative in accordance with a preferred embodiment of the present invention.
Figure 3A:
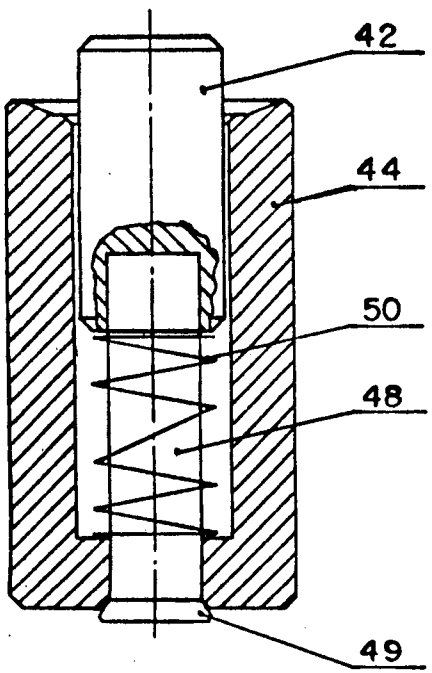
Figure 3C:
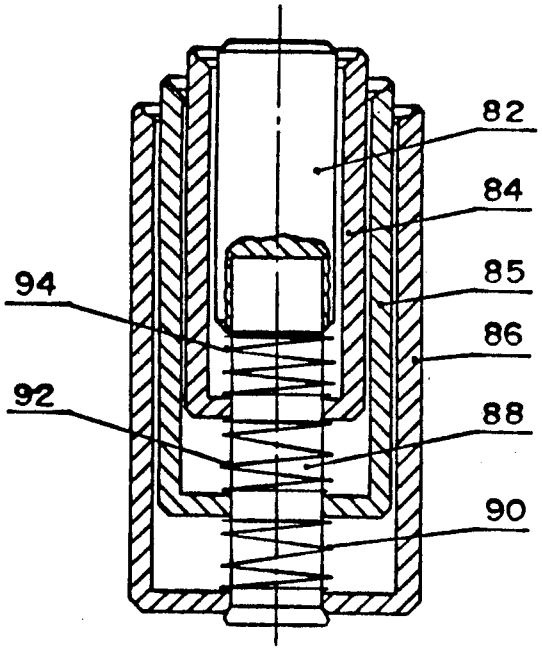

Reference is now made to FIGS. 3A, 3B and 3C which illustrate various embodiments of multi-element pin assemblies useful in the present invention. FIG. 3A illustrates an embodiment of the type illustrated in FIGS. 1 and 2 wherein the extension 48 is a separate element from core pin 42 and is embedded therein. Alternatively, pin 42 and extension 48 may be unitarily formed as in FIGS. 5A, 5B and 5C.

FIG. 3B illustrates a three part multi-element pin assembly 60 including a core pin element 62, an intermediate peripheral pin element 64 and an outer peripheral pin element 66. An extension 68 of pin element 62 is provided with two compression springs, spring 70, disposed between elements 64 and 66 and spring 72, disposed between pin elements 62 and 64.

FIG. 3C illustrates a four part multi-element pin assembly 80 including a core pin element 82, a first intermediate peripheral pin element 84, a second intermediate peripheral pin element 85 and an outer peripheral pin element 86. An extension 88 of pin element 82 is provided with three compression springs, spring 90, disposed between elements 85 and 86, spring 92 disposed between elements 84 and 85, and spring 94, disposed between pin elements 82 and 84.

Assembly of the multi-element pin assemblies of FIGS. 3A–3C may be achieved by first assembling the various pin elements onto each other with the corresponding springs and then joining the extension to the core pin element. Alternatively, when the extension is integrally formed with the core pin element, as in FIGS. 5A–5C, following assembly, the extreme end of the extension may be broadened, as by impact, such as hammering, or by any other suitable process.

Figure 4B:
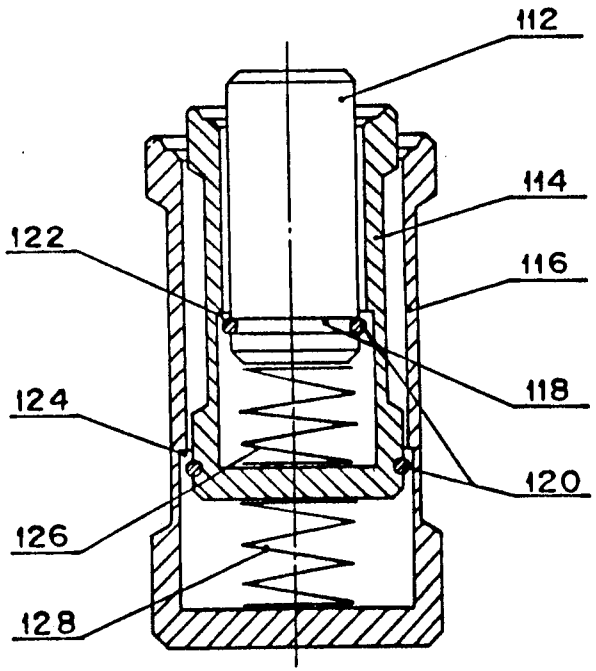
FIGS. 4A, 4B and 4C illustrate three alternative embodiments of multi-element pin assemblies constructed and operative in accordance with a further preferred embodiment of the present invention.
Figure 4A:
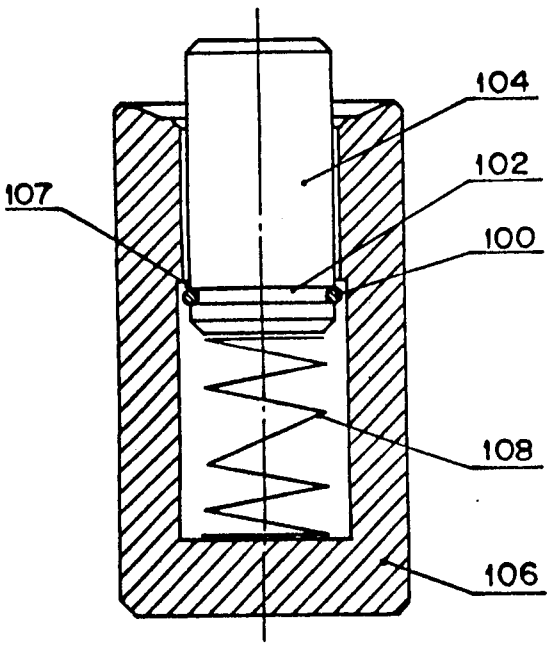
Figure 4C:
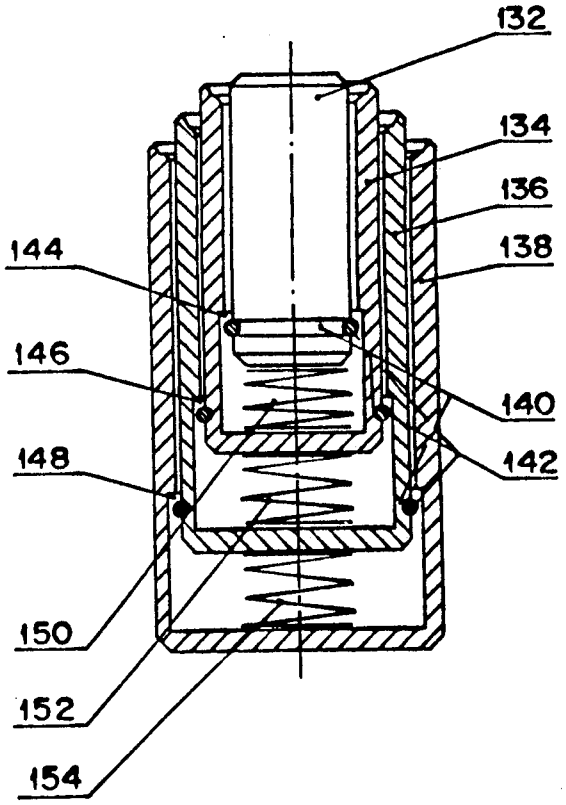

Reference is now made to FIGS. 4A, 4B and 4C which illustrate various alternative embodiments of multi-element pin assemblies useful in the invention. FIG. 4A illustrates a two part embodiment of the type illustrated in FIGS. 1 and 2 but wherein the extension and aperture are replaced by a retaining ring 100 seated in a groove 102 formed in a core pin 104. Core pin 104 is retained against disengagement from a peripheral pin element 106 by engagement of retaining ring 100 by a shoulder 107 defined in the peripheral pin element 106. A compression spring 108 urges core pin element 104 forward as shown.

FIG. 4B illustrates a three part multi-element pin assembly 110 including a core pin element 112, an intermediate peripheral pin element 114 and an outer peripheral pin element 116. Each of the pin elements 112 and 114 is formed with a circumferential groove 118 in which is seated a retaining ring 120. Element 112 is retained within peripheral pin element 114 by means of engagement of the corresponding retaining ring 120 with a shoulder 122 formed in element 114. Element 114 is retained within element 116 by engagement of the corresponding retaining ring 120 with a shoulder 124 formed in element 116. Two compression springs are provided: spring 126, disposed between elements 112 and 114 and spring 128, disposed between pin elements 114 and 116.

FIG. 4C illustrates a four part multi-element pin assembly 130 including a core pin element 132, a first intermediate peripheral pin element 134, a second intermediate peripheral pin element 136 and an outer peripheral pin element 138. Each of the pin elements 132, 134 and 136 is formed with a circumferential groove 140, in each of which is seated a retaining ring 142.

Element 132 is retained within peripheral pin element 134 by means of engagement of the corresponding retaining ring 142 with a shoulder 144 formed in element 134. Element 134 is retained within element 136 by engagement of the corresponding retaining ring 142 with a shoulder 146 formed in element 136. Element 136 is retained within element 138 by engagement of the corresponding retaining ring 142 with a shoulder 148 formed in element 138. Three compression springs are provided: spring 150, disposed between elements 132 and 134, spring 152, disposed between elements 134 and 136, and spring 154, disposed between pin elements 136 and 138.

Assembly of the apparatus of FIGS. 4A–4C may be effected by forcing the relatively interior pin elements with their retaining rings into the relatively exterior pin elements until past the corresponding shoulder.

Figure 5B:
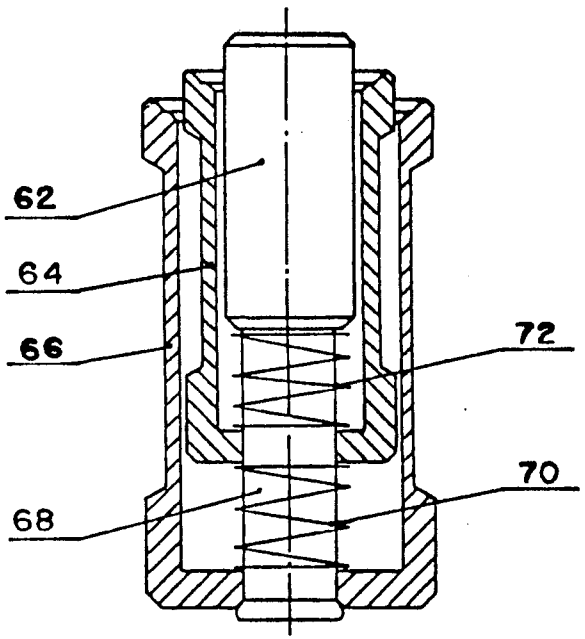
FIGS. 5A, 5B and 5C illustrate three alternative embodiments of multi-element pin assemblies constructed and operative in accordance with still a further preferred embodiment of the present invention.
Figure 5A:
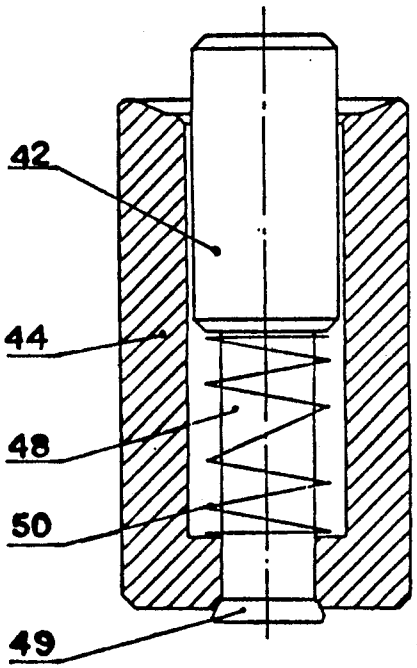
Figure 5C:
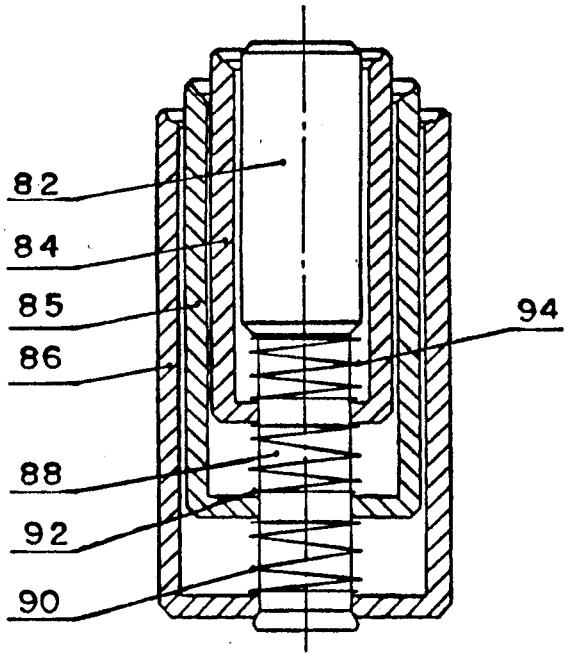

FIGS. 5A–5C illustrate an embodiment of the type illustrated in FIGS. 1 and 2 wherein the extension 48 is integrally formed with central pin 42. This embodiment resembles the embodiment of FIGS. 3A–3C, respectively, in all other respects. For convenience, similar reference numbers to the numbers used in FIGS. 3A–3C have been used in FIGS. 5A–5C to indicate corresponding elements.

It will be appreciated by persons skilled in the art that the present invention is not limited to what has been particularly shown and described hereinabove Rather the scope of the present invention is defined only by the claims which follow:

What is claimed is:

1. A cylinder lock comprising:

a housing;

a plug disposed in the housing and arranged for rotation relative thereto;

a first plurality of chambers formed in the housing;

a second plurality of chambers formed in the plug and arranged such that each one of the first plurality of chambers extends coaxially with a corresponding one of the second plurality of chambers, when the plug is in a first rotational orientation relative to the housing;

a first multi-element pin assembly disposed in said first plurality of chambers; and a second multi-element pin assembly being disposed in said second plurality of chambers;

said first multi-element pin assembly comprising:

an outer pin element having an axial recess, said outer pin element having a forward end facing said plug and a rearward end;

an inner pin element disposed for selectable axial orientation relative to the outer pin element, said inner pin element having a forward end facing said plug and a rearward end; and means for retaining the inner pin element against disengagement from and undesired misalignment with respect to the outer pin element, said means for retaining being operative to permit the forward end of said inner pin element to be disposed either substantially outwardly or inwardly of the substantially forward end of the outer pin element, thereby to permit independent positioning of the forward ends of said inner and outer pin elements within said first plurality of chambers.

2. A cylinder lock according to claim 1 and wherein the inner and outer pin elements are spring loaded with respect to one another.

3. A cylinder lock according to claim 1 and wherein the means for retaining the inner pin element comprises an axial extension of the inner pin element which slidably extends through a portion of the outer pin element and is configured so as not to be normally separable therefrom.

4. A cylinder lock according to claim 2 and wherein the means for retaining the inner pin element comprises an axial extension of the inner pin element which slidably extends through a portion of the outer pin element and is configured so as not to be normally separable therefrom.

5. A cylinder lock according to claim 1 and wherein the plug is formed with a plurality of circumferential grooves thereby defining a non-straight shear line between the housing and the plug.

6. A cylinder lock according to claim 2 and wherein the plug is formed with a plurality of circumferential grooves thereby defining a non-straight shear line between the housing and the plug.

7. A cylinder lock according to claim 3 and wherein the plug is formed with a plurality of circumferential grooves thereby defining a non-straight shear line between the housing and the plug.

8. A cylinder lock according to claim 4 and wherein the plug is formed with a plurality of circumferential grooves thereby defining a non-straight shear line between the housing and the plug.

* * * * *